US008439461B2

(12) United States Patent
Kim

(10) Patent No.: US 8,439,461 B2
(45) Date of Patent: May 14, 2013

(54) REFRIGERATOR AND METHOD OF FABRICATING THE SAME

(75) Inventor: Ju-Hyun Kim, Gyeongsangnam-do (KR)

(73) Assignee: LG Electronic Inc., Seoul (KR)

( * ) Notice: Subject to any disclaimer, the term of this patent is extended or adjusted under 35 U.S.C. 154(b) by 167 days.

(21) Appl. No.: 12/988,528

(22) PCT Filed: Jan. 20, 2009

(86) PCT No.: PCT/KR2009/000297

§ 371 (c)(1),
(2), (4) Date: Oct. 19, 2010

(87) PCT Pub. No.: WO2010/021440

PCT Pub. Date: Feb. 25, 2010

(65) Prior Publication Data

US 2011/0126578 A1 Jun. 2, 2011

(30) Foreign Application Priority Data

Aug. 20, 2008 (KR) ..... 10-2008-0081396
Aug. 20, 2008 (KR) ..... 10-2008-0081397
Aug. 20, 2008 (KR) ..... 10-2008-0081400

(51) Int. Cl.
*A47B 96/04* (2006.01)

(52) U.S. Cl.
USPC ..... 312/405; 312/204

(58) Field of Classification Search ..... 312/204, 312/405
See application file for complete search history.

(56) References Cited

U.S. PATENT DOCUMENTS 3,759,753 A * 9/1973 Becca ..... 428/209
4,400,252 A * 8/1983 Ushijima ..... 204/478
5,252,360 A * 10/1993 Huttl et al. ..... 427/249.17
5,358,326 A * 10/1994 Cherry et al. ..... 312/405
5,591,551 A * 1/1997 Audett et al. ..... 430/18
6,387,468 B1 * 5/2002 Kim et al. ..... 428/67
7,105,218 B1 * 9/2006 Klemm et al. ..... 428/68
7,481,957 B1 * 1/2009 Adickes ..... 264/261
8,104,853 B2 * 1/2012 Kim et al. ..... 312/405
2003/0035917 A1 * 2/2003 Hyman ..... 428/67

(Continued)

FOREIGN PATENT DOCUMENTS

EP 0826489 * 3/1998
JP 2003-042648 A 2/2003

(Continued)

OTHER PUBLICATIONS

Chinese office action dated Mar. 6, 2012 for Application No. 200980119168.1 with English translation, 12 pages.

(Continued)

*Primary Examiner* — Hanh V Tran
(74) *Attorney, Agent, or Firm* — Fish & Richardson P.C.

(57) ABSTRACT

A refrigerator is provided. The refrigerator includes a main body in which a storage chamber is provided and a door on which an image is provided. The door is pivotably coupled to the main body. The door includes a door panel defining an outer appearance of the door, a pattern processing part disposed on a side of the door panel to realize the image, and a glass member fixed to the door panel. According to the refrigerator, an elegant outer appearance of the door is realized to satisfy consumers' desires and increase consumer confidence.

7 Claims, 4 Drawing Sheets

U.S. PATENT DOCUMENTS

| | | | | |
|---|---|---|---|---|
| 2009/0202796 | A1* | 8/2009 | Koo et al. | 428/209 |
| 2010/0109494 | A1* | 5/2010 | Jung | 312/228 |
| 2010/0116005 | A1* | 5/2010 | Jung et al. | 68/212 |
| 2010/0141102 | A1* | 6/2010 | Jung et al. | 312/204 |
| 2010/0147602 | A1* | 6/2010 | Jung et al. | 178/18.06 |

FOREIGN PATENT DOCUMENTS

| | | | | |
|---|---|---|---|---|
| JP | 2003-065668 | A | | 3/2003 |
| JP | 2004330747 | A | * | 11/2004 |
| KR | 1999049580 | A | | 7/1999 |
| KR | 2005031488 | A | | 4/2005 |
| KR | 10-2005-0099051 | A | | 10/2005 |
| KR | 2006128233 | A | | 12/2006 |
| KR | 10-2008-0065096 | A | | 7/2008 |
| WO | WO 2007/148922 | A1 | | 12/2007 |
| WO | WO 2008/084928 | A2 | | 7/2008 |

OTHER PUBLICATIONS

International Search Report dated Aug. 28, 2009 for Application No. PCT/KR2009/000297, 2 pages.

Chinese Office Action dated Aug. 8, 2012 for Application No. 200980119168.1, with English Translation, 19 pages.

Korean Office Action issued in Application No. 10-2008-0081396, dated Apr. 30, 2010, 3 pages.

Korean Office Action issued in Application No. 10-2008-0081397, dated Apr. 30, 2010, 4 pages.

Korean Office Action issued in Application No. 10-2008-0081400, dated Apr. 30, 2010, 4 pages.

* cited by examiner

REFRIGERATOR AND METHOD OF FABRICATING THE SAME

TECHNICAL FIELD

Embodiments relate to a refrigerator and a method of fabricating the same, and more particularly, a refrigerator in which a structure of a refrigerator door is improved to realize an elegant outer appearance of the door, thereby satisfying consumers' desires and increasing consumer confidence.

BACKGROUND ART

In general, refrigerators are electric home appliances which maintain their inner space at a temperature lower than an outside temperature to store foods in refrigerated or frozen states for a long time.

Such a refrigerator includes a body in which a storage chamber for storing cool air is provided and a door pivotably coupled to the body.

Generally, the door includes an out case defining an outer appearance of a front surface of the door and a door liner defining an outer appearance of a back surface of the door. An insulating material for insulation is filled between the out case and the door liner.

Consumers these days have various standards of selection when purchasing the refrigerator. That is, the consumers take account of an elegant design in addition to proper performances of the refrigerator.

Particularly, a color or design of the door occupying many of an outer appearance of the refrigerator is one of factors that can strongly appeal to the consumers.

In a related art refrigerator, an out case of a door is frequently formed of a steel sheet in order to reinforce a strength. Thus, there is a limitation that the steel sheet is relatively monotonous in color.

Thus, in case where proper patterns are not provided on a surface of the steel sheet, it is difficult to present a polished or elegant image required by a user.

As a result, in recent, the out case of the refrigerator door is frequently formed of stainless steel. Since the stainless steel has proper luster and texture, the outer appearance of the refrigerator may become more elegant.

However, there is a limitation that the stainless steel is weak in strength. In addition, there are limitations that the stainless steel is expensive, a manufacturing process is complicated, and a manufacturing thereof is not easy.

DISCLOSURE OF INVENTION

Technical Problem

Embodiments provide a refrigerator door in which an out case of a refrigerator is surface-treated to realize an elegant outer appearance of the refrigerator.

Embodiments also provide a refrigerator door in which a door panel is patterned to realize a delicate design.

Embodiments also provide a refrigerator door in which a glass member is fixed to a patterned door panel to reinforce a strength of a door.

Embodiments also provide a refrigerator door in which a glass member is fixed to a door panel by a fixing member to express the door using a design having a three-dimensional effect.

Technical Solution

In one embodiment, a refrigerator includes: a main body in which a storage chamber is provided; and a door on which an image is provided, the door being pivotably coupled to the main body, wherein the door includes: a door panel defining an outer appearance of the door; a pattern processing part disposed on a side of the door panel to realize the image; and a glass member fixed to the door panel.

In another embodiment, a refrigerator includes: a main body in which a storage chamber is provided; and a door pivotably coupled to the main body, wherein the door includes: a door panel on which an image is disposed; a glass member provided on a front surface of the door panel; and a fixing member fixing the glass member to the door panel.

In further another embodiment, a refrigerator includes: a main body in which a storage chamber is provided; and a door pivotably coupled to the main body, wherein the door includes: a door panel defining an outer appearance of the door; a pattern processing part disposed on a side of the door panel, the pattern processing part including a corrosion processing portion and a corrosion prevention portion; a tempered glass shielding a front surface of the door panel; and a fixing member sealing the door panel with the tempered glass.

In even further another embodiment, a method of fabricating a refrigerator includes: sketching a pattern on a front surface of a door panel; corroding the door panel along the sketched pattern; fixing a fixing member to the front surface of the door panel; and fixing a glass member to a front surface of the fixing member.

Advantageous Effects

According to the refrigerator including the above-described components, the out case of the refrigerator can be surface-treated to realize the elegant outer appearance.

Also, the door pattern can be patterned using the photo-etching method to realize the delicate design of the refrigerator door.

Also, since the glass member is fixed to the front surface of the patterned door panel, the door can be reinforced in strength.

Also, the glass member is fixed to the door panel by the fixing member to enhance the three-dimension effect of the design realized on the door.

Also, the glass member can be easily fixed to the portion at which the etching process is not performed on the door panel, thereby to accomplish the sealing effect on the refrigerator door.

Also, it can prevent the door panel from being corroded or oxidized due to the sealing effect of the refrigerator door.

MODE FOR THE INVENTION

Hereinafter, specific embodiments of the present disclosure will be described with reference to the accompanying drawings. However, the spirit of the invention is not limited to the embodiments. Other retrograde inventions by adding, changing or deleting other components or other embodiments within the scope of the invention may be easily proposed.

Figure 1:
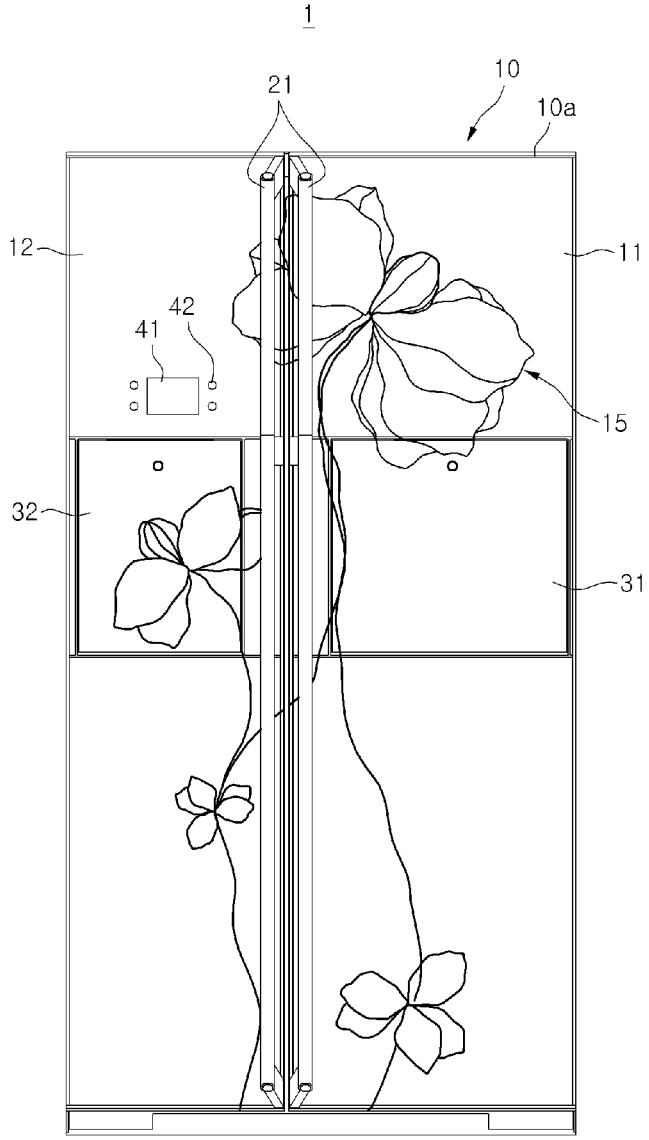
FIG. 1 is a perspective view of a refrigerator door according to a first embodiment.

FIG. 1 is a perspective view of a refrigerator door according to a first embodiment.

Referring to FIG. 1, a refrigerator 1 according to this embodiment includes a main body (not shown) including a refrigerating compartment and a freezing compartment and a refrigerator door 10 pivotably coupled to a front portion of the main body.

The refrigerator door 10 includes an out case 10*a* defining an outer appearance of a front surface thereof and a door liner (not shown) defining an outer appearance of a back surface thereof. An insulating material is provided between the out case 10*a* and the door liner.

The refrigerator door 10 further includes a refrigerating compartment door 11 selectively shielding the refrigerating compartment and a freezing compartment door 12 selectively shielding the freezing compartment.

The refrigerating compartment door 11 and the freezing compartment door 12 include a refrigerating compartment home bar 31 and a freezing compartment home bar 32 that can easily insert and dispense stored goods, respectively.

The freezing compartment door 12 includes a display part 41 for displaying an operation state of the refrigerator and a manipulation part 42 provided at a side of the display part 41 to manipulate an operation of the refrigerator.

The refrigerating compartment door 11 and the freezing compartment door 12 further include door handles 21 grasped by a user to open and close the refrigerator door 10, respectively. Each of the door handles 21 is disposed in a length direction of the refrigerator door 10.

An image 15 for providing a brilliant outer appearance is respectively disposed on the refrigerating compartment door 11 and the freezing compartment door 12. Hereinafter, a configuration of the image 15 and a method of fabricating the same will be described.

Figure 2:
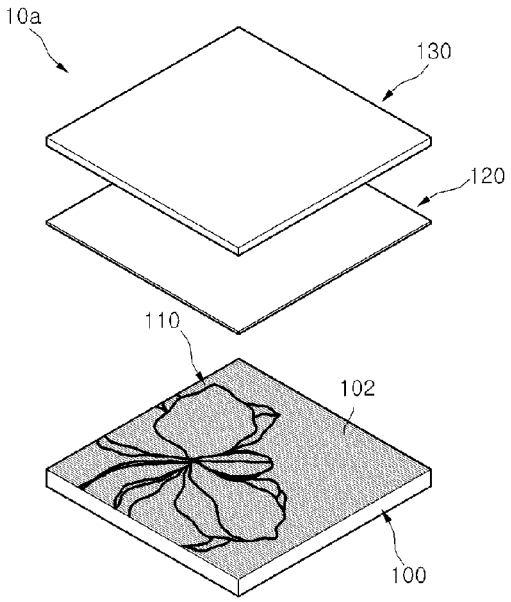
FIG. 2 is an exploded perspective view illustrating an out case of the refrigerator door according to the first embodiment.

FIG. 2 is an exploded perspective view illustrating an out case of the refrigerator door according to the first embodiment.

Referring to FIG. 2, the out case 10*a* of the refrigerator door 10 according to this embodiment includes a door panel 100 having a plate shape, a glass member 130 disposed at an upper side of the door panel 100, and a fixing member 120 disposed between the door panel 100 and the glass member 130 to fix the glass member 130 to the door panel 100.

In detail, the door panel 100 may be formed of a metal material. A material that can easily patterned, i.e., a material on which an etch process is easily performed may be used as the metal material.

A line formation part 102 in which a surface of the door panel 100 is processed to form lines in a predetermined direction is disposed on the door panel 100.

A pattern processing part 110 for providing the image 15 is disposed on the door panel 100. The pattern processing part 110 denotes a portion that is surface-treated using a photo-etching process. The photo-etching process will be described below.

The fixing member 120 has a thin-film shape. The fixing member 120 fixes the glass member 130 to the door panel 100 using an adhesion method.

A pressure sensitive adhesive (PSA) may be used as the fixing member 120.

The PSA is a material in which a predetermined pressure is applied to allow an object to be endowed with an adhesive force when a specific surface of the object to be attached is fixed. Also, the PSA may have an adhesive characteristic at room temperature, and the portion to be attached may have the adhesive characteristic even if a low pressure is applied.

The fixing member 120 is fixed to an upper portion of the door panel 100 including the pattern processing part 110. The glass member 130 is provided on the fixing member 120.

The glass member 130 is formed of a tempered glass having a relative high strength by being hardened by heat. The glass member 130 is disposed on a front surface of the out case 10*a*. The out case 10*a* or the door panel 100 may be reinforced in strength by the glass member 130.

Since the front surface of the door panel 100 is isolated from an external environment due to the glass member 130, it can prevent the door panel 100 from being corroded or oxidized by moisture, etc.

Figure 3:
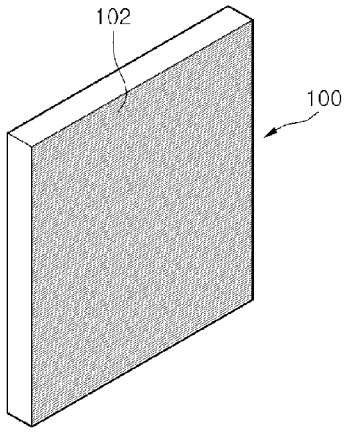
FIG. 3 is a perspective view of a door panel according to the first embodiment.
Figure 4:
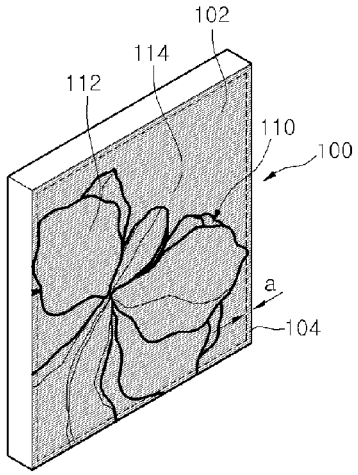
FIG. 4 is a perspective view of a process in which a pattern processing part is formed on the door panel according to the first embodiment.
Figure 5:
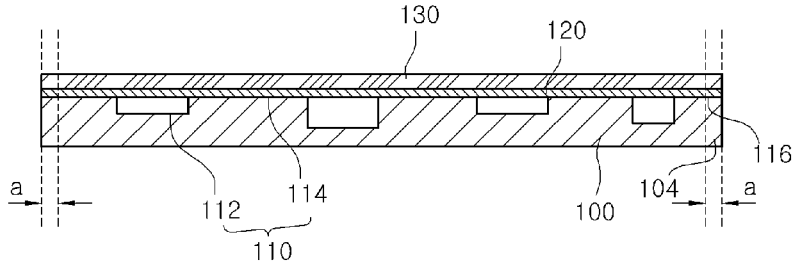
FIG. 5 is a cross-sectional view of the refrigerator door according to the first embodiment.

FIG. 3 is a perspective view of a door panel according to the first embodiment, FIG. 4 is a perspective view of a process in which a pattern processing part is formed on the door panel according to the first embodiment, and FIG. 5 is a cross-sectional view of the refrigerator door according to the first embodiment.

Referring to FIGS. 3 to 5, the door panel 100 according to the first embodiment has an approximately rectangular parallelepiped shape. Also, the door panel 100 has a size corresponding to that of an opened front surface of the main body of the refrigerator 1. The door panel 100 may be formed of a metal plate, and a steel sheet may be used as the metal plate.

The door panel 100 includes the line formation part 102. A polishing process is performed on the door panel 100 in a predetermined direction to form the line formation part 102.

That is, the door panel 100 may be surface-treated to form the line formation part 102. In detail, a surface of the door panel 100 is polished by a processing equipment using a sandpaper having an appropriate grit to form the line formation part 102. The line formation part 102 may have an uneven pitch shape by speedily rotating the sandpaper.

The door panel 100 may have a superior texture due to the line formation part 102. Also, the door panel 100 may have an elegant outer appearance that can be expressed by a material such as the stainless material. Since the door panel 100 has the uneven surface, it can prevent glaringness due to diffused reflection from occurring.

The pattern processing part 110 for providing the image 15 is disposed on the door panel 100. The pattern processing part 110 may be realized using a photo-etching technique.

The pattern processing part 110 may be realized in a state where the line formation part 102 is disposed on the door panel 100.

The photo-etching technique is an ultra precision machining technology in which a photoresist is coated on a surface of a metal, and the coated surface is divided into a portion on which ultraviolet rays are irradiated and a portion on which the ultraviolet rays are not irradiated to selectively corrode the metal.

In detail, the photo-etching technique is a technique that integrates a photolithography technique with an etching technique.

The photolithography technique is a technique in which a photoresist is coated on a panel, and the coated photoresist is selectively exposed and developed to ultraviolet rays passing through a photomask (film including patterns) to form patterns on the panel.

The etching technique is a technique in which a surface of an object is selectively corroded using a developed photoresist layer as a protection layer. That is, in the etching technique, a metal surface on which the protection layer is not formed is punched and cut by chemical corrosion or electrolytic corrosion using an acid, alkali, or ferricchloride solution to perform a recess process.

Lastly, the protection layer is removed using the alkali solution or an organic solvent, and then, a finishing process may be performed.

The pattern processing part includes a recessed portion 112 recessed in a downward direction of the front surface of the door panel 100 and a fixing portion 114 disposed on at least side of the recessed portion 112 to fix the fixing member 120 thereto. A plurality of recessed portions 112 may be provided in the front surface of the door panel 100.

That is, when the door panel 100 is corroded using the photo-etching technique, the front surface of the door panel 100 becomes uneven. A recessed portion is defined as the recessed portion 112, and a protruded portion is defined as the fixing portion 114.

Here, the recessed portion 112 is a portion that is corroded using the photo-etching process, and the fixing portion 114 is a portion that is protected from the corrosion due to the photoresist, i.e., prevented from being corroded.

The plurality of recessed portions 112 may have depths or widths different from each other from the front surface of the door panel 100.

Also, when the fixing member 120 is fixed to the door panel 100, the fixing member 120 is fixed to only the fixing portion 114 and is not fixed to the recessed portion 112. Thus, in a case where the fixing member 120 is fixed to the fixing portion 114, the fixing member 120 is spaced from the recessed portion 112.

The glass member 130 is fixed to the fixing portion 114 by the fixing member 120.

When the fixing member 120 is fixed to the door panel 100, it may seem like a different shade and texture. That is, it can maximize a three-dimensional effect in which the pattern processing part 110 is seen from the outside.

In detail, a portion of light proceeding toward the door panel 100 may be reflected from the front surface of the glass member 130, and another portion may be reflected from a front surface of the fixing member 120. The light reflected from the glass member 130 and the light reflected from the fixing member 120 may be reflected at reflection angles different from each other.

A further another portion of the light may be reflected from a front surface of the fixing portion 114, and a remaining portion of the light may be reflected from the inside of the recessed portion 112. That is, the light may be reflected at reflection angles different from each other.

The plurality of recessed portions 112 may have the depths or widths different from each other. In this case, the light may be reflected at different reflection angles from the recessed portions 112 from each other.

When the light is reflected at the reflection angles different from each other, it may shine with the different degrees of brightness when seen from the outside.

As described above, since the light is reflected from surfaces different from each other to generate a path different, the three-dimensional effect may be different depending on angle viewed.

Even a delicate line ranging from about 0.02 mm to about 0.03 mm may be expressed on the door panel 100 using the photo-etching technique.

A corrosion prevention portion 104 for preventing the corrosion is disposed on the door panel 100. The corrosion prevention portion 104 may have a width "a" on an end portion of the door panel 100.

That is, the corrosion prevention portion 104 has the width "a" from each of edges of the door panel 100 toward an inward direction.

The fixing member 120 may be fixed to the corrosion prevention portion 104. In detail, the fixing member 120 may be surface-attached to the corrosion prevention portion 104. Thus, the corrosion prevention portion 104 may become a portion of the fixing portion 114 fixed to the fixing member 120.

A sealing portion 116 fixed to the corrosion prevention portion 104 is provided on the fixing member 120. The sealing portion 116 may have a size corresponding to that of the corrosion prevention portion 104.

Since the corrosion prevention portion 104 has a smooth surface, the fixing member 120 may be easily attached to the corrosion prevention portion 104.

Since the fixing member 120 adheres (is closely attached) to the edge portion of the door panel 100, it can prevent the fixing member 120 from being come off from the front surface of the door panel 100. Thus, it can prevent the glass member 130 provided on the fixing member 120 from being come off.

Since the edge portion of the door panel 100 is sealed by the fixing member 120, it can prevent water or moisture from being introduced from the front surface of the door panel 100. In this case, it can prevent the door panel 100 from being corroded.

That is to say, since the fixing member 120 may be closely attached to the glass member 130, it can prevent the water from being introduced between the door panel 100 and the glass member 140.

A method of fabricating an out case of a door including the above-described components will be described.

A door panel 100 having a size corresponding to that of an opened front surface of a main body of a refrigerator is prepared. A polishing process is performed on the door panel 100 to form a line formation part 102 on the surface of the door panel 100.

A picture or character to be patterned is sketched on the door panel 100.

A photoresist is coated on the door panel 100 according to a sketched shape. The door panel 100 is selectively etched using the developed photoresist as a protection layer. That is, it combines the door panel 100 with a photo-etching technique.

According to the photo-etching technique, a recessed portion 112 formed by corrosion and a fixing portion 114 to which a fixing member 120 is fixed are formed.

The fixing member 120 is fixed to the door panel 100. Here, the fixing member 120 is selectively fixed to only the fixing portion 114. As a result, a shade, a texture, and a three-dimensional effect may be maximized by the fixing method of the fixing member 120.

A corrosion prevention portion 104 in which the photo-etching technique is not applied is formed on an edge portion of the door panel 100. The fixing member 120 is closely attached to the corrosion prevention portion.

Thus, it can prevent the fixing member 120 from being come off from the front surface of the door panel 100. As a result, the refrigerator is sleek and clean in an outer appearance thereof.

Also, it can prevent the door panel 100 from being introduced from the outside to the front surface due to the coupling the fixing member 120. Therefore, the refrigerator door can be prevented from being corroded.

Since the front surface of the door panel 100 is shielded by a glass member 130 and the edge portion of the door panel 100 is sealed, it can prevent the door panel 100 from being corroded or oxidized.

Another embodiment is proposed.

Although the photoresist is coated and developed using the photo-etching technique, and then is corroded using chemicals in the embodiment, the present disclosure is not limited thereto.

For example, a desired image may be sketched on the door panel to polish the door panel using a sandpaper according to the sketched shape.

In addition, various methods in which a desired image can be corroded on the door panel except the above-described embodiment may be applied within the spirit and scope of the appended claims.

Hereinafter, a sealing structure of a door panel according to a second embodiment will be described. When compared with the first embodiment, only the sealing method of the door panel is different. Thus, the difference will be mainly described, and the same parts will be described using the reference numerals and the description of the first embodiment.

Figure 6:
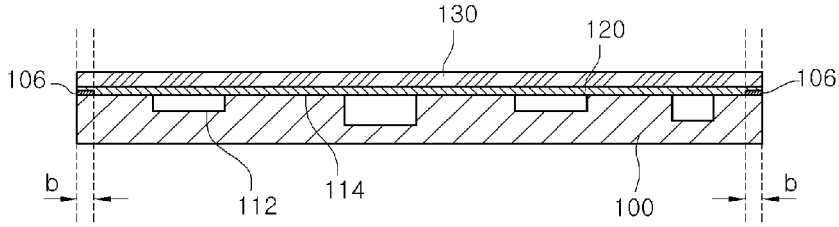
FIG. 6 is a cross-sectional view of a refrigerator door according to a second embodiment.

FIG. 6 is a cross-sectional view of a refrigerator door according to a second embodiment.

Referring to FIG. 6, a first sealing member 106 is provided between a door panel 100 and a fixing member 106. The first sealing member 106 may be formed of a material having a film shape.

The first sealing member 106 has a width "b" along an edge portion of the door panel 100.

The fixing member 120 may be closely attached to the door panel by the first sealing member 106. Since a glass member 130 is fixed to the fixing member 120, the glass member 130 may be sealed with the door panel 100.

Thus, it can prevent the fixing member 120 and the glass member 130 from being come off from a front surface of the door panel 100. Also, it can prevent water or moisture from being permeated between the glass member 130 and the door panel 100.

In summary, although the sealing effect is accomplished by the corrosion prevent portion 104 and the sealing portion 116 in the first embodiment, the same effect as the sealing effect may be accomplished by the first sealing member 106 in this embodiment.

Figure 7:
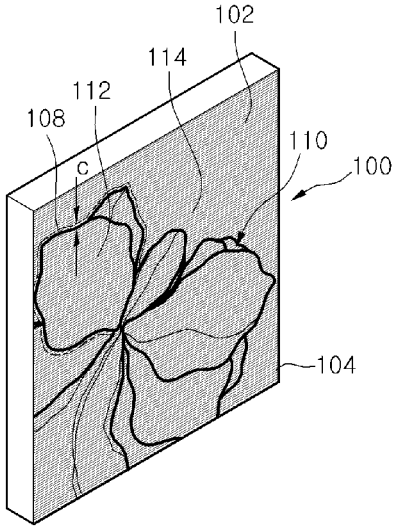
FIGS. 7 and 8 are views of a refrigerator door according to a third embodiment.
Figure 8:
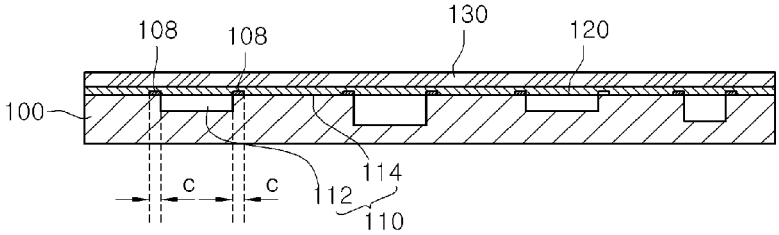

FIGS. 7 and 8 are views of a refrigerator door according to a third embodiment.

Referring to FIGS. 7 and 8, a refrigerator door 11 according to a third embodiment includes a door panel 100 defining an outer appearance thereof and a pattern processing part 110 in which the door panel 100 is patterned to realize a specific image.

The pattern processing part 110 includes a recessed portion 112 formed by corrosion and a fixing portion 114 to which a fixing member is fixed. The recessed portion 112 and the fixing portion 114 have the same configuration as those of the first embodiment.

A second sealing member 108 is provided at an external side of the recessed portion 112 to seal the fixing member 120 with the door panel 110.

The second sealing member 108 may be formed of a material having a film shape.

The second sealing member 108 may extend with a width "c" along the recessed portion 112, i.e., an edge portion of an image 15 disposed on a door.

The fixing member 120 may be closely attached to the door panel 100 by the second sealing member 108. Since a glass member 130 is fixed to the fixing member 120, the glass member 130 may be sealed with the door panel 100.

Thus, it can prevent the fixing member 120 and the glass member 130 from being come off from a front surface of the door panel 100. Also, it can prevent moisture from being introduced into the recessed portion 112 by being permeated between the glass member 130 and the door panel 100.

Figure 9:
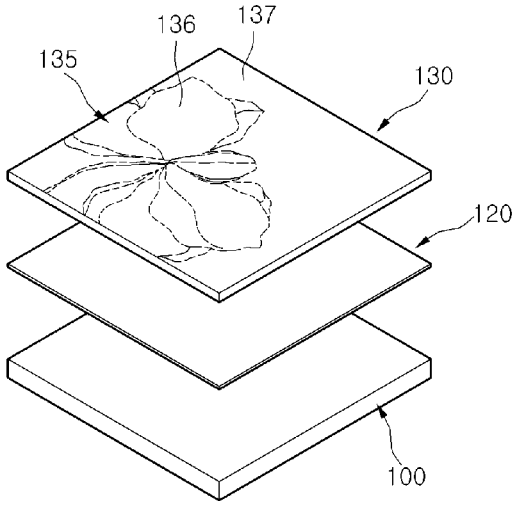
FIG. 9 is an exploded perspective view illustrating an out case of a refrigerator door according to a fourth embodiment.

FIG. 9 is an exploded perspective view illustrating an out case of a refrigerator door according to a fourth embodiment.

Referring to FIG. 9, an out case of a refrigerator door according to a fourth embodiment includes a glass member 130 disposed on a pattern processing part 134 in order to realize a specific image.

Unlike the first embodiment, the pattern processing part 135 is disposed on a surface of the glass member 130 in this embodiment. A formation process of the pattern processing part 135 is equal to that of the pattern processing part 110 described in the first embodiment.

In FIG. 9, although the pattern processing part 135 is disposed on a bottom surface of the glass member 130, the present disclosure is not limited thereto. For example, the pattern processing part 135 may be disposed on a top surface of the glass member 130.

A fixing member 120 is provided on the door panel 100, and the glass member 130 is fixed to an upper portion of the fixing member 130. These configurations are equal to those of the first embodiment.

Figure 10:
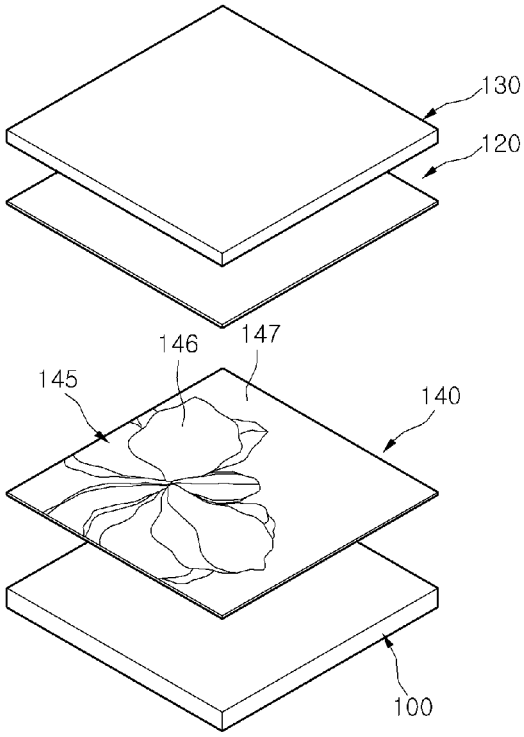
FIG. 10 is an exploded perspective view illustrating an out case of a refrigerator door according to a fifth embodiment.

FIG. 10 is an exploded perspective view illustrating an out case of a refrigerator door according to a fifth embodiment.

Referring to FIG. 10, an out case of a refrigerator door according to a fifth embodiment includes a printing layer 140 on which a design or pattern is printed on a door panel 100.

A transfer-printed film may be applied as the printing layer, and the printing layer may be realized using a silk-screen method.

A surface of the printing layer 140 is corroded to form a pattern processing part 145. The pattern processing part 145 includes a recessed portion 146 and a fixing portion 147. The pattern processing part 145 has the same configuration as that of the first embodiment.

The printing layer 140 is provided between the door panel 100 and a fixing member 120. That is, the fixing member 120 is provided on the printing layer 140.

The fixing member 120 is not fixed to the recessed portion 146, but fixed to only the fixing portion 147.

In this case, various three-dimensional effects and textures may be realized depending on a reflection angles different of light.

INDUSTRIAL APPLICABILITY

According to the refrigerator including the above-described components, since the out case of the refrigerator can be surface-treated to realize the elegant outer appearance, industrial applicability can remarkably increase.

The invention claimed is:

1. A refrigerator, comprising:

a main body in which a storage chamber is provided; and a door on which an image is provided, the door being pivotably coupled to the main body, wherein the door comprises:

a door panel that includes a metal plate, the door panel including:

a polished line formation part directly formed on a frontal surface of the metal plate, the polished line formation part including a plurality of lines extending in a predetermined direction and being configured to reduce glare due to diffused reflection; and a pattern processing part directly formed in the polished line formation part to realize the image, the pattern processing part including:

a plurality of recessed portions recessed by corrosion to reflect light in a predetermined angle from insides thereof;

a plurality of fixing portions between the plurality of recessed portions; and a corrosion prevention portion disposed along an edge of the frontal surface of the metal plate and having a smooth surface;

a glass member placed on the frontal surface of the metal plate and configured to block water or moisture from directly contacting the pattern processing part and corroding the metal plate;

a fixing member interposed between the glass member and the door panel to fix the glass member to the frontal surface of the metal plate, the fixing member being configured to contact the fixing portions of the pattern processing part; and a sealing portion provided between the fixing member and the metal plate, wherein the sealing portion is fixed to the corrosion prevention portion to block water or moisture from being introduced to the pattern processing part.

2. The refrigerator according to claim 1, wherein at least a part of the plurality of recessed portions have depths or widths different from each other such that light may be reflected at different reflection angles.

3. The refrigerator according to claim 2, wherein the fixing member is spaced from the recessed portion.

4. The refrigerator according to claim 1, wherein the fixing member is spaced from the recessed portion.

5. The refrigerator according to claim 1, wherein the fixing member includes a thin-film shaped adhesive.

6. The refrigerator according to claim 5, wherein the fixing member includes a pressure sensitive adhesive.

7. The refrigerator according to claim 1, wherein the sealing portion is configured to have a size corresponding to that of the corrosion prevention portion.

* * * * *